US006022002A

United States Patent [19]

Niggli

[11] Patent Number: 6,022,002

[45] Date of Patent: Feb. 8, 2000

[54] APPARATUS FOR THE ASSISTED HANDLING OF A LOAD

[75] Inventor: Roman Niggli, Menzikea, Switzerland

[73] Assignee: Kerebel Limited, Dublin 2, Ireland

[21] Appl. No.: 08/957,009

[22] Filed: Oct. 23, 1997

[51] Int. Cl.[7] ..... B66D 1/58

[52] U.S. Cl. ..... 254/273; 212/279; 254/270

[58] Field of Search ..... 254/270, 272, 254/273, 337, 362; 212/274, 279

[56] References Cited

U.S. PATENT DOCUMENTS

| | | | |
|---|---|---|---|
| 2,254,910 | 9/1941 | Richards et al. | 254/272 |
| 3,203,672 | 8/1965 | Santos | 254/270 |
| 3,889,929 | 6/1975 | Pamer | 254/270 |
| 3,994,476 | 11/1976 | Van Gennep | 254/272 |
| 4,042,213 | 8/1977 | Schreyer et al. | 254/270 |
| 4,491,301 | 1/1985 | Pendola . | |
| 5,314,082 | 5/1994 | Konop | 212/274 |
| 5,662,311 | 9/1997 | Waedekin et al. | 254/273 |

FOREIGN PATENT DOCUMENTS

| | | |
|---|---|---|
| 0733579 | 9/1996 | European Pat. Off. . |
| 1376858 | 9/1964 | France . |
| 1404485 | 5/1965 | France . |
| 1576220 | 7/1969 | France . |
| 1106050 | 5/1961 | Germany . |
| 2118040 | 4/1971 | Germany . |
| 2523690 | 12/1976 | Germany . |
| 2019018 | 10/1979 | United Kingdom . |

*Primary Examiner*—Katherine A. Matecki
*Attorney, Agent, or Firm*—Rothwell, Figg, Ernst & Kurz, p.c.

[57] ABSTRACT

An apparatus for the assisted handling of a load includes at least one motor unit, which actuates the winding and unwinding of a flexible traction element; one or more guiding sheaves; and a detector for detecting the weight of the load and the force applied thereto, arranged at an element for supporting the guiding sheave that is arranged directly downstream of the pulley or drum actuated by the motor unit.

10 Claims, 1 Drawing Sheet

APPARATUS FOR THE ASSISTED HANDLING OF A LOAD

BACKGROUND OF THE INVENTION

1. Field of the Invention

The present invention relates to an apparatus for the assisted handling of a load, i.e., to an apparatus used to lift a load and guide it manually within the limits of a preset space, reducing as much as possible the effort required by the operator who performs these maneuvers.

The apparatus according to the present invention is used for example in a station for assembling mechanical components along a mass-production line or at a station for distributing products or semifinished items meant to be sorted toward machines that perform additional processes.

2. Description of the Background Art

An example of a conventional apparatus is given in Italian patent application no. MI95/A000541, which discloses an apparatus comprising: a supporting structure; means for engaging or accommodating the load; at least one motor unit which actuates the winding and unwinding of a flexible element on a pulley or on a drum; one or more sheaves for guiding the flexible traction element, which are arranged between the pulley and the load engagement means; and means for detecting the weight of the load and the force applied thereto in at least one direction of motion. In an embodiment described in the prior patent application, the apparatus is of the overhead type and the means for detecting the weight of the load and the force applied thereto are constituted by a load cell arranged at the free end of the flexible traction element, at the load engagement means.

The load cell is therefore arranged in a position which is particularly exposed to accidental impacts which can compromise its operation.

In this apparatus it is also necessary to install a different load cell according to the maximum intended capacity of each device. In other words, as the number of reevings of the flexible traction element varies, it is necessary to use different load cells, i.e., load cells capable of detecting the load in the preset operating range for which the device is preset during design and manufacture.

As an alternative, in order to adapt this device to greater loads it would be necessary to install a plurality of load cells. This solution, however, is particularly complicated in terms of the control of the motor unit as a function of the signals generated by the different load cells.

It should also be noted that load cells meant to detect loads over different ranges can also significantly differ in their manufacturing technology, in the characteristics of the signal provided in output, in their error tolerances or in other similar characteristics and accordingly require different automatic control circuits.

This contributes to the particularly high manufacturing costs of these devices, especially in terms of stocks of materials, such as load cells and associated electronic control circuits, which must be kept in store in order to allow production of devices meant for different maximum capacities.

SUMMARY OF THE INVENTION

Accordingly, the aim of the present invention is to provide an apparatus for the assisted handling of loads which uses a single kind of load cell regardless of the maximum capacity of the apparatus.

This aim is achieved by the present invention, which relates to an apparatus for the assisted handling of a load, of the type comprising: a supporting structure; means for engaging or accommodating the load; at least one motor unit, which actuates the winding and unwinding of a flexible traction element on a pulley or on a drum; one or more guiding sheaves for the flexible traction element, which are arranged between the pulley or drum and the means for engaging or accommodating the load; and means for detecting the weight of the load and the force applied thereto in at least one direction of motion; characterized in that the means for detecting the weight of the load and the force applied thereto are arranged at an element for supporting the guiding sheave that is arranged directly downstream of the pulley or drum along the path of the flexible element.

The advantages of the solution proposed by the present invention are evident. First of all, it is possible to use a single kind of load cell, since the resulting force detected by the load cell is always within a preset range, regardless of the number of reevings of the flexible traction element. In other words, regardless of the maximum capacity of the apparatus, the cell detects only the force that acts on the guiding sheave arranged directly downstream of the pulley or drum on which the flexible traction element is wound.

Another advantage of the present invention is the fact that the load cell is arranged in a position which is certainly less subject to impacts than in conventional devices.

According to a possible embodiment of the present invention, the load cell is arranged in a frame which connects the supporting structure to a bracket that supports the pulley arranged directly downstream of the drum for winding the flexible traction element. The force detected by the load cell is only a fraction of the total load and it is therefore possible to use a single load cell, which operates over a range which is always limited, regardless of the maximum capacity of the device.

According to another possible embodiment of the present invention, the load cell is instead arranged directly in the supporting hub of the single sheave arranged directly downstream of the drum on which the flexible traction element is wound. In this case it is possible to install additional guiding sheaves coaxially to the one on which the load is measured, thus limiting the overall dimensions of the device.

The embodiments of the present invention preferably use a load cell of the off-center type, i.e., a load cell which is capable of detecting the force to which it is subjected regardless of the point of application of said force with respect to the cell.

BRIEF DESCRIPTION OF THE DRAWINGS

The invention is now described in greater detail with reference to the accompanying drawings, given by way of non-limitative example and wherein.

DETAILED DESCRIPTION OF THE PREFERRED EMBODIMENTS

Figure 1:
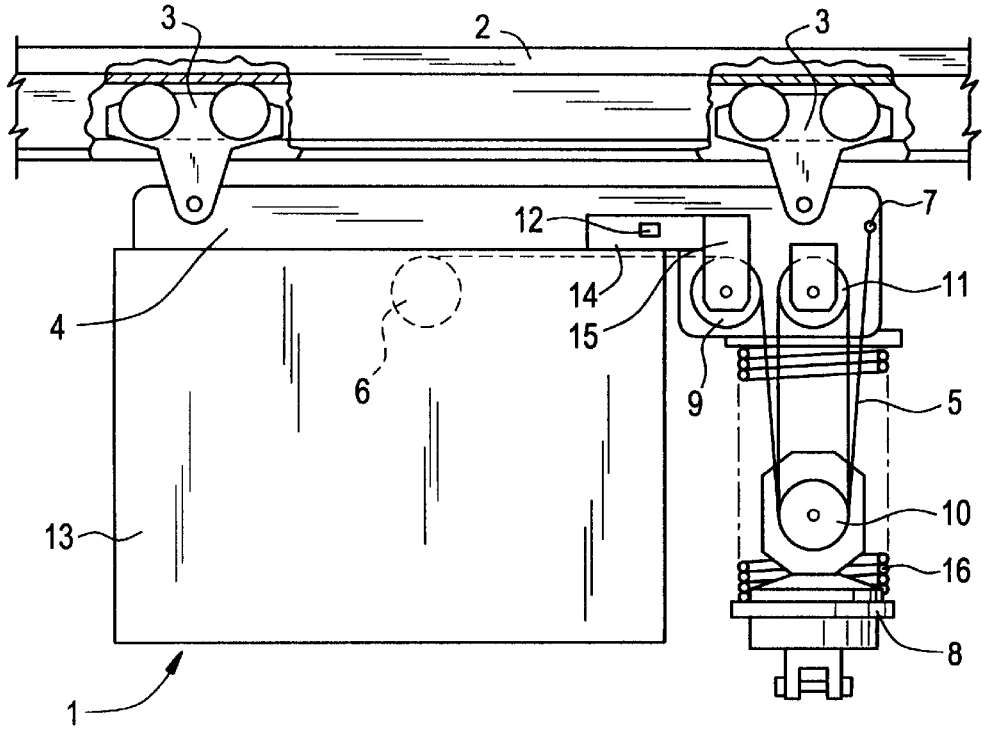
FIG. 1 is a side view of a device according to a first embodiment of the present invention.

The device 1 is suspended on a guiding rail 2, which is provided for example in the shape of a box-like body, and can move along the rail 2 by means of the trucks 3. Said trucks are connected to the casing 13 of the motor unit by means of a bracket 4.

In the embodiment shown in FIG. 1, the flexible traction element 5 is wound onto a drum 6 which is mechanically connected to an electric motor unit (not shown) and is fixed at one end to the drum 6. The flexible traction element 5 passes from the drum 6 to a first guiding sheave 9, which guides it toward the moving part 8, which is rigidly coupled to the means for engaging or accommodating the load (not shown).

Depending on the intended capacity of the device 1, the flexible traction element 5 then passes through a lower guiding assembly, which is rigidly coupled to the moving part 8 and comprises one or more sheaves 10, and through an upper guiding assembly, which is rigidly coupled to the bracket 4 and comprises one or more sheaves 11. The free end of the flexible traction element 5 is then fixed at 7 to the bracket 4. The presence of the guiding assemblies and the number of sheaves 10 and 11 in each assembly is of course a function of the maximum capacity for which the device 1 must be preset, and so is the point where the free end of the flexible traction element 5 is fixed to the bracket 4 or to the moving part 8. For example, in the embodiment shown in FIG. 1, the lower guiding assembly comprises at least two sheaves 10, whilst the upper guiding assembly comprises a single sheave 11.

According to the embodiment of the present invention shown in FIG. 1, the means for detecting the weight of the load and the force applied thereto comprise a load cell 12, which is arranged in a frame 14 which connects the casing 13 to a bracket 15 for supporting the pulley 9.

A spiral conductor 16 allows to connect any sensors or other electrical control device (not shown), associated with the means for engaging the load, to the safety or control devices accommodated in the casing 13.

Figure 2:
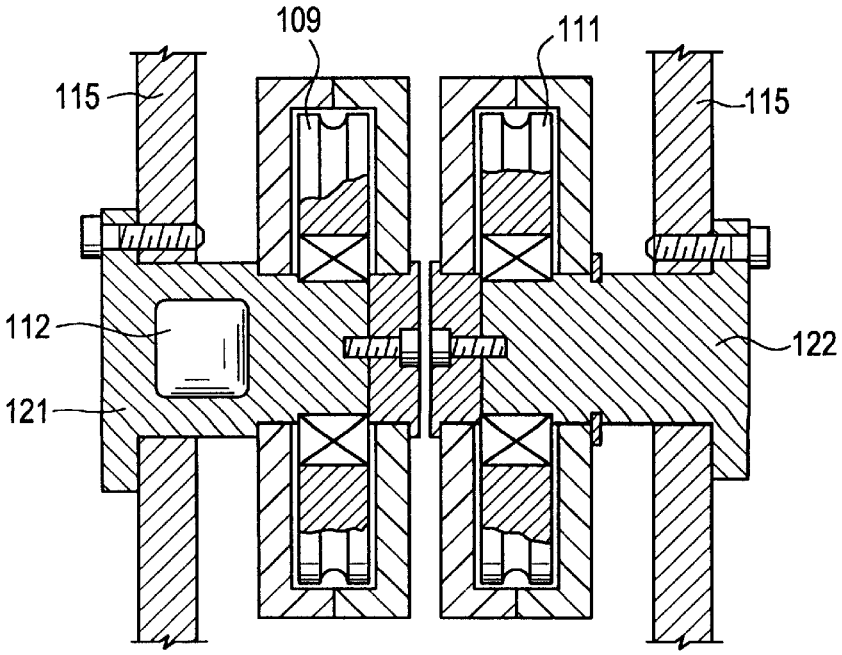
FIG. 2 is an enlarged-scale sectional view of a detail of the device according to a second possible embodiment of the invention.

FIG. 2 illustrates another embodiment of the present invention, according to which the means for detecting the weight of the load and the force applied thereto are constituted by a load cell 112, which is accommodated in the hub 121 of the sheave 109 arranged directly downstream of the drum 6. In this case, the sheave 109 and the sheave 111 of the upper guiding assembly are fitted coaxially on the same supporting bracket 115 but have independent hubs 121 and 122, in order to allow to detect the weight and the force applied to the load only on the sheave 109. This embodiment is particularly compact with respect to the one shown in FIG. 1, because of the possibility of arranging the sheave 109 and the guiding sheaves 111 in a coaxial position.

The load cells 12 and 112 fitted to the device according to the present invention are preferably of the off-center type in order to offer greater freedom in choosing the position of the cell. This type of load cell is known in the art, and is capable of measuring the load even when the position of the cell is off-center with respect to the point of application of said load, as indeed occurs in the embodiments of the present invention.

The signal generated by the load cell 12 or 112 is routed to a circuit for controlling the power delivered by the electric motor. Said circuit comprises a section for processing the signal according to a preset program. In particular, when the operator starts or stops the movement of the load, the signal detected by the cell 12 or 112 varies. The motor is then controlled so as to compensate for this variation. However, this causes an oscillation of the signal detected by the cell 12 or 112 and accordingly causes an oscillation of the load which can even reach the resonance frequency. In order to eliminate this danger, the signal is filtered so that an equalized signal, whose amplitude corresponds to the average value of the signal detected by the cell 12 or 112, is emitted at the output of the filter circuit.

I claim:

1. An apparatus for assisted handling of a load, comprising:

means for engaging said load;

a flexible traction element connected to the load-engaging means;

a rotatable member onto which the flexible traction member is wound and unwound;

a guiding sheave arrangement for guiding said flexible traction element along a path between said rotatable member and said load-engaging means, said guiding sheave arrangement including a guiding sheave located at a directly downstream position with respect to said rotatable member along the path of said flexible element, and a guide support for said guiding sheave at said directly downstream position; and at least one means for detecting a weight of the load and a force applied to the load in at least one direction of motion, the detecting means being mounted on said guide support.

2. The apparatus of claim 1 wherein the at least one detecting means comprises a single load cell capable of generating an electrical signal which represents the weight of the load and the force applied thereto.

3. The apparatus of claim 2 further comprising a support structure for supporting said guide support, wherein said guide support comprises a bracket for supporting said rotatable member, and a connecting structure portion for connecting said support structure to said bracket, wherein said load cell is mounted on the connecting structure portion of said guide support.

4. The apparatus of claim 3 further comprising a support structure for supporting said guide support, a guiding rail, and a suspension for suspending the support structure from said guiding rail for movement along said guiding rail.

5. The apparatus of claim 2 wherein said guide support includes a hub supporting said sleeve, and wherein said load cell is mounted in said hub.

6. The apparatus of claim 5 further comprising a support structure for supporting said guide support, a guiding rail, and a suspension for suspending the support structure from said guiding rail for movement along said guiding rail.

7. The apparatus of claim 2 wherein said load cell is positioned off-center with respect to a point of application of said load on said guide support, and wherein said load cell is capable of measuring said load in said off-centered position.

8. The apparatus of claim 7 further comprising a support structure for supporting said guide support, a guiding rail, and a suspension for suspending the support structure from said guiding rail for movement along said guiding rail.

9. The apparatus of claim 2 further comprising a support structure for supporting said guide support, a guiding rail, and a suspension for suspending the support structure from said guiding rail for movement along said guiding rail.

10. The apparatus of claim 1 further comprising a support structure for supporting said guide support, a guiding rail, and a suspension for suspending the support structure from said guiding rail for movement along said guiding rail.

* * * * *

UNITED STATES PATENT AND TRADEMARK OFFICE

CERTIFICATE OF CORRECTION

PATENT NO. : 6,022,002
DATED : February 8, 2000
INVENTOR(S) : Roman Niggli

It is certified that error appears in the above-identified patent and that said Letters Patent is hereby corrected as shown below:

Title page, Column 1,
Line 3, Under "Inventor": please replace "Menzikea" with -- Menziken --.
Line 6, After the filing date, please insert the following section: -- Foreign Application Priority Data: October 23, 1996 Switerland 2591/96 --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,022,002
DATED : February 8, 2000
INVENTOR(S) : Roman Niggli

It is certified that error appears in the above-identified patent and that said Letters Patent is hereby corrected as shown below:

Title Page,
Item [73], under "Assignee": please replace "Kerbel Limited, Dublin 2, Ireland" with -- Dorben Company Limited, Vaduz, Liechtenstein --.

Signed and Sealed this

Ninth Day of October, 2001

*Attest:*

Nicholas P. Godici

*Attesting Officer*

NICHOLAS P. GODICI
*Acting Director of the United States Patent and Trademark Office*